United States Patent [19]

Kurowski et al.

[11] 4,090,334

[45] May 23, 1978

[54] AIR ERASER

[75] Inventors: Benedict Kurowski, Des Plaines; George Sack, Chicago, both of Ill.

[73] Assignee: Paasche Airbrush Co., Chicago, Ill.

[21] Appl. No.: 636,415

[22] Filed: Dec. 1, 1975

[51] Int. Cl.[2] ..... B24C 5/02; B24C 5/04; B24C 7/00

[52] U.S. Cl. ..... 51/427; 51/436; 51/438

[58] Field of Search ..... 51/8 R, 8 HD, 11, 12, 51/427, 436, 438; 222/405; 239/336

[56] References Cited

U.S. PATENT DOCUMENTS

| | | | |
|---|---|---|---|
| 1,276,653 | 8/1918 | Herbert | 222/405 X |
| 2,305,976 | 12/1942 | McKnight | 51/8 HD |
| 2,441,441 | 5/1948 | Paasche | 51/8 HD |
| 2,526,403 | 10/1950 | Paasche | 51/8 HD |
| 3,032,929 | 5/1962 | Glesener | 51/12 X |
| 3,201,901 | 8/1965 | Pauli | 51/12 |
| 3,344,558 | 10/1967 | Kirkland | 51/11 |

FOREIGN PATENT DOCUMENTS

| | | | |
|---|---|---|---|
| 322,237 | 9/1903 | France | 51/12 |

*Primary Examiner*—Gary L. Smith
*Attorney, Agent, or Firm*—Olson, Trexler, Wolters, Bushnell & Fosse, Ltd.

[57] ABSTRACT

An air eraser is provided generally in the nature of a slightly enlarged pen. Compressed air carries particulate abrasive material from the pen for abrasive removal or erasure of indicia or the like on a base. A trigger controlled air valve is provided upstream of the abrasive material whereby it is impossible for any abrasive material to clog the valve. The flow stream through the air eraser is a straight-through one so that there is no problem of abrasive errosion of corners within the eraser.

4 Claims, 5 Drawing Figures

10
12
14
16
18
20
22
24
26
28
30
32
34
36
38
40
42
44
46
48
50
52
54
56
60
84
3
4

AIR ERASER

BACKGROUND OF THE INVENTION

Air brushes are widely used in the graphic arts and elsewhere for depositing or applying paint, ink and other pigments by atomizing paint and the like into a moving air stream. Conversely, it is also known to provide an air eraser in which very fine abrasive grit is carried by a moving air stream in order abrasively to remove pigments from a base or substrate. Prior art air erasers have been plagued by various problems. In some instances they have been difficult to hold and to aim. Various constructional features, such as valving of the air stream with entrained abrasive particulate material, or movement of such an air stream about corners has caused undersired precipitation of the abrasive particulate material with resulting clogging of the flow passages. In some instances the reservoir or the like for the abrasive material has been of a restricted size, or has interfered with facile operation of the air eraser.

SUMMARY OF THE INVENTION

The object of the present invention is to provide an air eraser which overcomes the defects of the prior art. This is effected by the provision of a pencil-like tool easily held in the manner of a pencil or pen, or in the manner of the well-known air brush. A container for abrasive particulate material is located relatively remote to the pencil-like tool and is connected thereto by flexible tubing. The pencil-like tool is connected to a source of air under pressure, and a trigger on the air eraser operates a valve to valve the air on and off at a point well upstream from the container of abrasive material. Thus, opening or closing of the valve is entirely independent of and is not affective by the abrasive material. The air stream established by opening of the valve carries air under pressure through the aforesaid tubing to the container and agitates the abrasive particulate material therein, thereby entraining a certain amount of the particulate material in the moving air stream which then proceeds through further flexible tubing to the air eraser, where it moves through a straight-through path and exits from a nozzle on the air eraser to impinge against ink, and other like materials on a substrate or base in order abrasively to remove the same.

BRIEF DRAWING DESCRIPTION

DETAILED DESCRIPTION

Figures 1, 2:
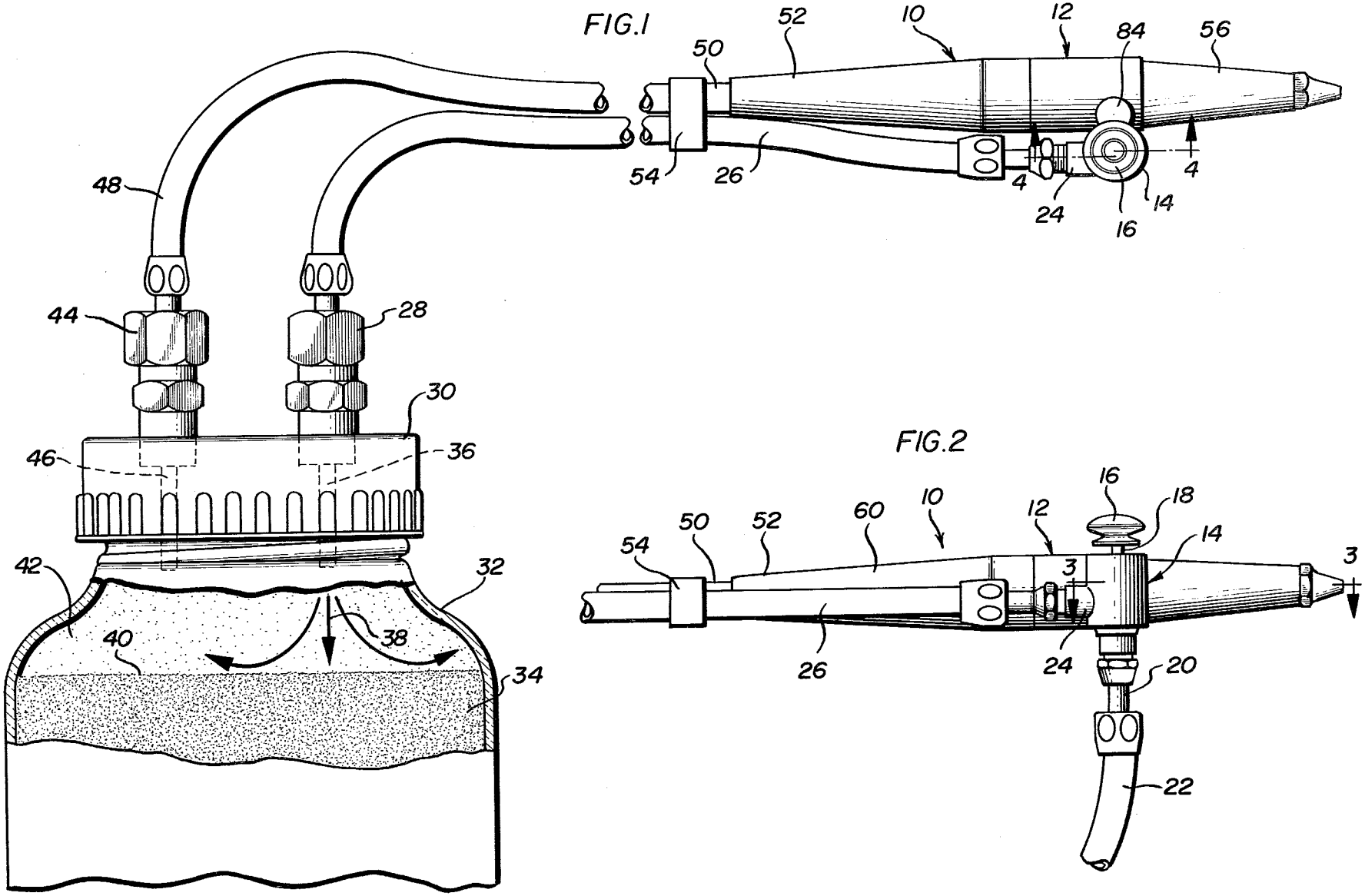
FIG. 1 is a plan view of an air eraser including the storage container therefor.
FIG. 2 is a side view of the air eraser.

Returning now to the drawings in greater detail, and first to FIGS. 1 and 2, there will be seen an air eraser 10 constructed in accordance with the principles of the present invention, and including a generally pencil-like body 12 with an air valve 14 mounted near the front end and on the side thereof. The air valve is controlled by a push button 16 on a shaft 18. Air under pressure is admitted to the valve 14 through a suitable fitting 20 and a flexible pressure hose 22 from a suitable source.

In addition to the inlet fitting 20 the valve 14 is provided with an outlet fitting 24 leading to an air hose 26 which, in turn, leads to an inlet fitting 28 in the screw-on lid 30 of a canister 32 containing particles of abrasive or gritty material 34 therein. The upper portion of the container or canister 32 is substantially empty, and when air under pressure is admitted to the hose 26 from the valve 14 a restricted pipette 36 connected to the bottom of the inlet fitting 28 blows air downwardly at high velocity as indicated by the arrow 38, such air impinging against the top surface 40 of the particulate or abrasive material 34 in the canister 32, and thereby stirring up a substantially invisible cloud of particles 42 within the top portion of the container or canister.

The lid 30 is provided with an outlet fitting 44 having an inlet pipette 46. The outlet fitting 44 is connected to another pressure hose 48 which leads to an inlet fitting 50 at the inlet or rear end 52 of the pencil-like device or body 12. The hoses 48 and 26 conveniently are strapped together at 54 adjacent the rear or inlet end of the body 12.

Figures 3, 4, 5:
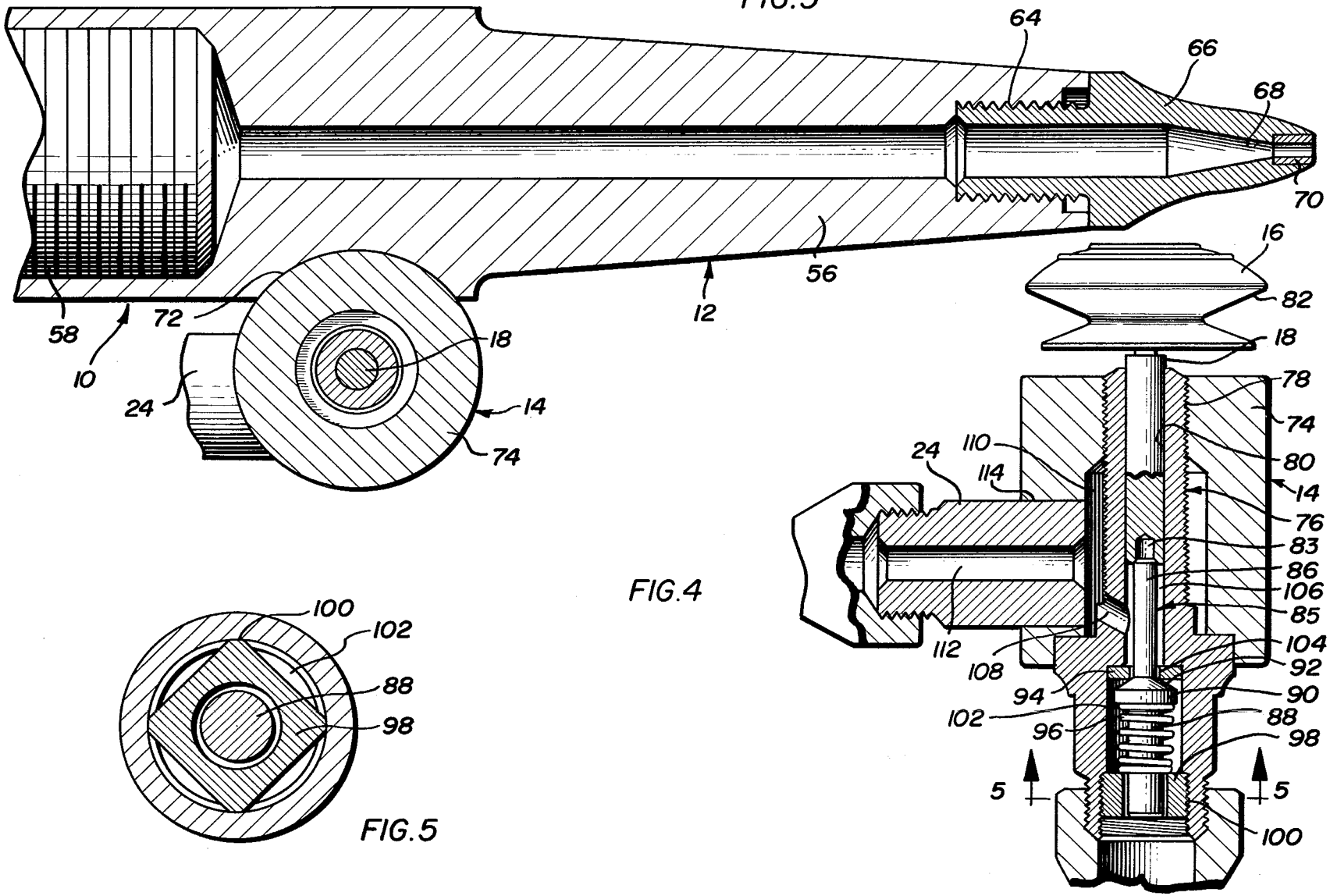
FIG. 3 is an enlarged fragmentary sectional view through the air eraser as taken along the line 3—3 in FIG. 2.
FIG. 4 is a fragmentary enlarged view taken along the line 4—4 in FIG. 1.
FIG. 5 is a cross sectional view taken along the line 5—5 in FIG. 4.

The body 12 is on the order of about 5 inches long. The container or canister 32 is located remotely relative to the body, and is on the order of four inches in diameter, and on the order of about five inches in height exclusive of the lid 30. The container or canister is large enough that it can hold a very large working quantity of abrasive particulate material, and the remote location thereof makes it unnecessary for the container or canister to be lifted or otherwise moved about. It will be observed that the terminal end of the air pressure hose 48 is in straight line or axial alignment with the body 12, whereby no sharp bends are made. It will also be observed that air under pressure is valved by the valve 14 long before the air reaches the particulate matter, whereby there is no possibility of precipitation thereof and consequent jamming of the valve. The pencil-like body 12 comprises a forward shell 56 which is internally threaded at its rear end at 58 (FIG. 3) for threadedly receiving a reduced front end portion of a handle 60. The handle tapers from front to rear, while the central portion of the body 12, namely the rear portion of the shell 56 is of cylindrical configuration, with the forward portion thereof tapering from rear to front. The entire body is provided with a straight through longitudinal bore 62, and a forward portion thereof is counter-bored and threaded at 64 for receipt of a nozzle or tip 66 with an inwardly tapered bore 68 at the forward portion thereof terminating in a cylindrical carboloy insert 70.

Near the front of the cylindrical portion of the shell 56 there is a tangential cylindrical scallop or recess 72 in which the cylindrical body 74 of the valve 14 is secured, as by silver soldering. It will be observed that there is no fluid connection between the valve body 74 and the shell 56.

An air valve casing 76 is provided with an upwardly extending threaded shank which extends through the valve body 74 and is threaded therein near the upper portion thereof at 78, the shank extending slightly above the top of the casing 74. The valve casing is provided with a longitudinal bore 80 of uniform diameter in which the plunger 18 is axially reciprocable. The finger button 16 is threaded on an upward extension of the air valve plunger 18 and is provided with a peripheral groove for kerf 82. The head 84 (FIG. 1) of a stop screw threaded into the shell 56 fits within the kerf 82, and hence limits axial reciprocation of the button 16 and air valve plunger 18. Adjustment of the axial reciprocation can be effected by turning the stop 84 which has a knurled periphery to facilitate such turning, thereby screwing the shaft or stud of the stop 84 in or out of the shell.

The plunger 18 is recessed at its lower end at 83 and receives the upper end of an air valve plunger 85 having an upper shaft 86 of restricted diameter joined to a lower shaft 88 of somewhat larger diameter at a valve closure member 90 having a bevelled upper surface 92. Bevelled surface 92 is engageable with a valve washer or seat 94, and is spring urged upwardly by means of a helical spring 96 encircling the enlarged diameter lower shaft 88 and bearing against a square nut 98 threaded at 100 into the lower end of an axial inlet chamber 102 at the bottom end of the valve casing 76 on to which the inlet fitting 20 is threaded. As best will be seen in FIG. 5 the square nut 98 is externally threaded at its corners only, whereby there is adequate clearance along the flat sides between the nut and the wall of the inlet chamber 102 for passage of air under pressure from the source through the hose or tube 22. A certain amount of air also may pass between the lower shaft 88 and the central hole of the nut 98.

The valve seat or washer 94 is provided with a central bore or hole 104 through which air may pass from the inlet chamber 102 to an intermediate chamber 106 of larger diameter and in which the upper shaft 86 extends with considerable radial space. An oblique lateral bore 108 communicates exteriorly with a chamber 110 within the valve body 74, which chamber communicates with a longitudinal bore 112 in the outlet fitting 24, the latter being soldered or otherwise secured in place in a radial bore 114 in the valve body 74.

Accordingly, when finger or thumb pressure is exerted axially down against the button 16 the valve plunger 84 is depressed against the force of the spring 96, thereby permitting air to pass from the inlet hose or tubing 96 to the outlet hose or tubing 26 leading to the storage canister 32. It is worthy of repetition at this point that only air passes through the control valve 14. The abrasive particulate material is not entrained in the air stream until a later point, and hence can in no way clog, wear, or interfere with proper operations of the valve 14.

Once the particulate matter is picked up by the air from the canister 32 it passes through the tubing 48 with only a large radius bend, and then straight through the air eraser 10.

Also worthy of attention is the exit end of the air eraser. The carboloy insert 70 prevents wear at the exit, and produces a cylindrical pattern to the abrasive laden air exiting from the air eraser. The tip is much more securely held in the shell of the air eraser than in prior art devices due to the rather long length of the threaded interconnection at 64.

The particular example of the invention as herein shown and described is for illustrative purposes only. Various changes will no doubt occur to those skilled in the art, and will be understood as forming a part of the present invention insofar as they fall within the spirit and scope of the appended claims.

The invention is hereby claimed as follows:

1. An air eraser comprising an elongated body having an outlet nozzle at one end thereof, an inlet at the opposite end of said body and a straight through flow passage extending longitudinally through said body and connecting said inlet and said outlet nozzle free of any intervening obstruction, an air valve mounted on said body and spaced laterally of said flow passage, said valve having manually operable means for opening and closing said valve, means providing an air inlet to said valve and adapted for connection to a source of air under pressure, means providing an air outlet from said valve for passing air under pressure out from said valve when said valve is open, a remote container for abrasive particulate material, flexible conduit means connecting said valve outlet to said container, and flexible conduit means connecting said container to said body inlet substantially in line with said flow passage to carry air under pressure with entrained abrasive particulate material from said container to said body and out through said outlet nozzle, said valve having a spring biased button engageable by a finger, and having a lateral kerf therein and further including a stop loosely received in said kerf and adjustable in the direction of travel of adjustment means cooperable with said button to limit travel thereof in either direction.

2. An air eraser as set forth in claim 1 wherein said container has inlet means connected to the first mentioned flexible conduit means and having a downwardly directed opening to impinge air under pressure against the upper surface of abrasive particulate material in said container to stir up said material for entrainment by air passing through said container.

3. An air eraser as set forth in claim 1 wherein said nozzle is threaded in said body, the length of the threaded connection being greater than the diameter thereof, said nozzle having a shoulder bottomming against the end of said body to limit threading in of said nozzle.

4. An air eraser as set forth in claim 1 wherein the flexible conduit means connecting the valve outlet to the container extends substantially parallel to said body rearwardly of said valve and is joined rearwardly of said body to the flexible conduit means connecting said container to said body inlet.

* * * * *